United States Patent [19]

Preissinger

[11] Patent Number: 4,731,599

[45] Date of Patent: Mar. 15, 1988

[54] COMBINED HIGH-VOLTAGE CURRENT AND VOLTAGE TRANSFORMER

[75] Inventor: Norbert Preissinger, Litzendorf, Fed. Rep. of Germany

[73] Assignee: MWB Messwandler-Bau AG, Bamberg, Fed. Rep. of Germany

[21] Appl. No.: 24,682

[22] Filed: Mar. 11, 1987

[30] Foreign Application Priority Data

Mar. 13, 1986 [DE] Fed. Rep. of Germany ..... 3608388
Mar. 13, 1986 [DE] Fed. Rep. of Germany ..... 3608389
Mar. 13, 1986 [DE] Fed. Rep. of Germany ..... 3608390

[51] Int. Cl.[4] ..... H01F 15/04; H01F 27/02; H01F 40/08

[52] U.S. Cl. ..... 336/84 C; 336/92; 336/107; 336/174

[58] Field of Search ..... 336/90, 92, 94, 96, 336/173, 174, 175, 105, 107, 195, 192, 84 C, 179

[56] References Cited

U.S. PATENT DOCUMENTS 3,380,009 4/1968 Miller ..... 336/92
4,117,437 9/1978 Ottesen ..... 336/174 X

FOREIGN PATENT DOCUMENTS 774638 5/1957 United Kingdom ..... 336/174

*Primary Examiner*—Thomas J. Kozma

*Attorney, Agent, or Firm*—Barnes & Thornburg

[57] ABSTRACT

A combined high voltage current and voltage transformer of head-type construction with a column of insulating material carrying the top housing whereby the active parts of the current transformer and above the same the active parts of the voltage transformer are arranged within the top housing. A simple manufacture of the top housing and a good seal with as few as possible lead-outs to be sealed off inside of the top housing is made possible by the construction of this invention. At the same time, the primary conductor of the current transformer as also the secondary system of the current transformer and the active parts of the voltage transformer are to be assemblable in a simple manner. This is achieved in that the primary conductor of the current transformer is constructed U-shaped whose base extends at least approximately concentrically through the ring of the secondary system of the current transformer. The two legs of the primary conductor protrude downwardly and are secured exclusively on the closure plate of the top housing from the inside thereof. At least one leg is electrically insulated from the metallic closure plate and is adapted to be contacted through the same from the outside and from below. The ring of the secondary system of the current transformer is also secured exclusively on the closure plate by way of supports.

27 Claims, 7 Drawing Figures

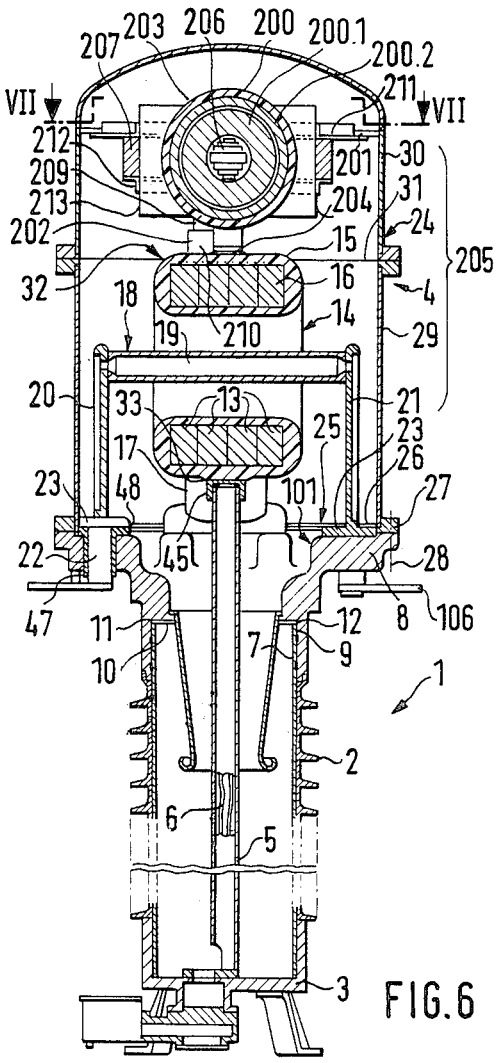
FIG.6
CROSS-SECTION A-B
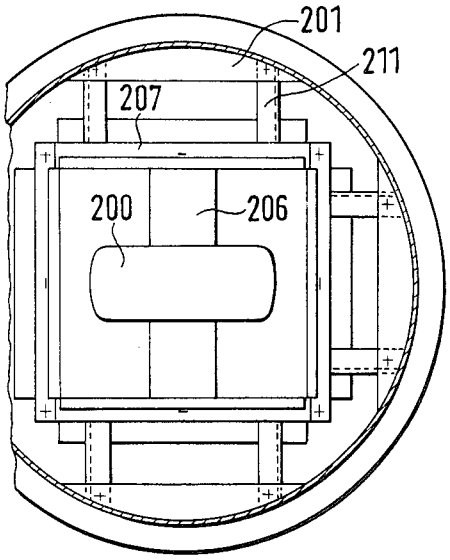
FIG.7
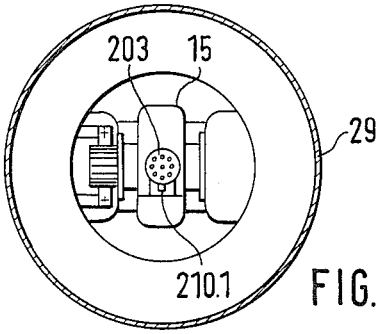
FIG.3
FIG.4
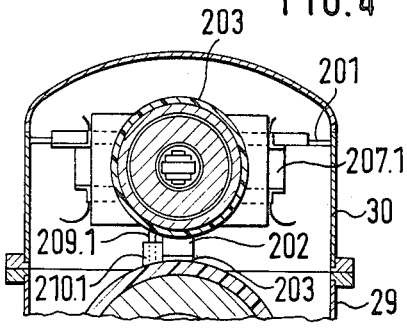

COMBINED HIGH-VOLTAGE CURRENT AND VOLTAGE TRANSFORMER

The present invention relates to a combined high voltage current and voltage transformer of head-type construction with a column of insulating material carrying the top housing whereby the active parts of the current transformer and by way of the latter the active parts of the voltage transformer are arranged in the top housing.

With prior art current transformers, it is known in principle that the lead-through conductor forming the primary conductor of the current transformer is arranged horizontally and is conducted laterally through the hood forming the top of the current transformer. At least one of the two lead-outs is thereby constructed electrically insulated. With high voltage current transformers of this type, the hood is thereby customarily constructed divided longitudinally, i.e., is of two-shelled construction (compare DE-OS No. 27 28 191).

Such a construction of a top hood therefore possesses not only three openings which must be tightly closed off during the assembly for purposes of subsequent filling with insulating liquid or with insulating gas under pressure but therebeyond includes the longitudinal separating line which must also be sealed off.

It is the aim of the present invention to so construct a combined high voltage current and voltage transformer of the aforementioned type that a simple manufacture of the top housing and a good seal with as few as possible lead-through places to be sealed off is made possible inside of the top housing. At the same time, both the primary conductor of the current transformer as also the secondary system of the current transformer and the active parts of the voltage transformer are to be assemblable in a simple manner.

The underlying problems are solved according to the present invention in that the primary conductor of the current transformer is constructed U-shaped whose base extends at least approximately concentrically through the ring of the secondary system of the current transformer and whose two legs protrude downwardly and are secured from the inside exclusively on the closure plate of the top housing consisting of the closure plate and of the hood secured thereon, whereby at least one leg is electrically insulated from the metallic closure plate and is adapted to be contacted through the closure plate from the outside and from below and in that the ring of the secondary system of the current transformer is secured by way of supports also exclusively on the closure plate.

In the construction of a combined transformer of head-type construction (upright construction) according to the present invention, all lateral openings in the top hood can be dispensed with. The top hood is completely relieved of the weight of the secondary system of the current transformer and must carry only the slight weight of the voltage transformer. Consequently, the top hood can be manufactured of considerably thinner material, possibly even in one piece by the deep-drawing process, and can therewith be manufactured in a considerably more cost-favorable manner and more light weight. Additionally, all current transformer parts can be preassembled on the closure plate and the voltage transformer can be preassembled in the hood by the construction according to the present invention, and the thus-preassembled units can be mounted on the insulating columns (support), respectively, on the closure plate and can be secured thereat. Also a plastic-film insulated bushing with grading control in the through-opening of the secondary system, as is frequently customary, can be dispensed with. Consequently, one is able to get along with a uniform insulating medium, especially with inert insulating gas such as sulfur hexafluoride, or also with insulating oil.

These and other objects, features and advantages of the present invention will become more apparent from the following description when taken in connection with the accompanying drawing which shows, for purposes of illustration only, several embodiments in accordance with the present invention, and wherein:

FIG. 3 is a cross-sectional view of the hood taken along line A-B of FIG. 1;

FIG. 4 is a cross-sectional view through the upper hood section with a voltage transformer having a shell core in accordance with the present invention;

FIG. 6 is a longitudinal cross-sectional view through a modified embodiment of a combined transformer in accordance with the present invention; and FIG. 7 is a plan view on the transformer according to FIG. 6, taken in the cross-sectional plane A-B of FIG. 6.

Figure 1:
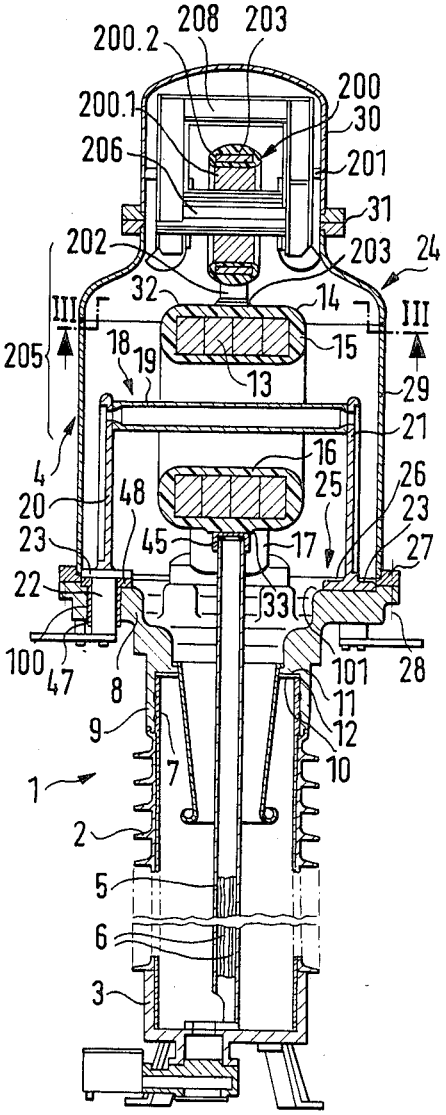
FIG. 1 is a longitudinal cross-sectional view through a combined high voltage current and voltage transformer according to the present invention, viewed from the side thereof.
Figure 2:
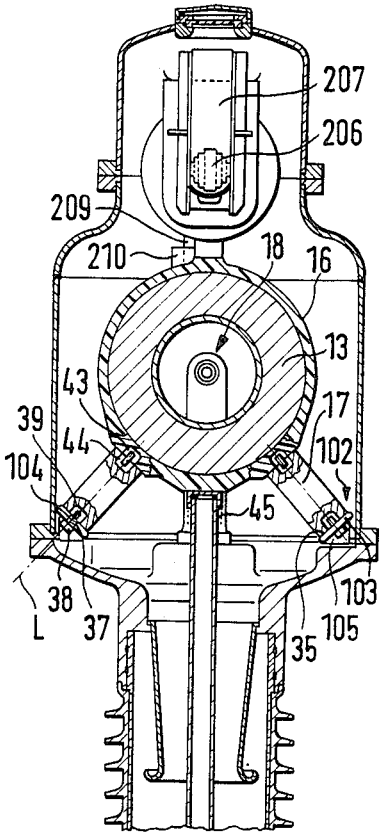
FIG. 2 is a cross-sectional view through the combined transformer according to FIG. 1 in a view rotated through 90° about the longitudinal axis.

Referring now to the drawing wherein like reference numerals are used throughout the various views to designate like parts, a high voltage current transformer of head-type construction which is in particular under the usual excess pressure of an inert insulating gas such as sulfur hexafluoride, is designated generally in FIG. 1 by reference numeral 1. The high voltage current transformer 1 essentially consists of a column of insulating material (support) such as porcelain, epoxy resins or of a compound insulator of a GFK-tubular member with cast-on silicon ribs, of a base part 3 carrying the insulating column 2 and of the top part generally designated by reference numeral 4 containing the active parts of the current and voltage transformer. A lead-out pipe 5 is arranged in the column 2 of insulating material and coaxially to the latter, in which are arranged the secondary lead-out lines 6 which lead to the secondary terminals in the base part 3. A potential control arrangement, especially a potential control winding may be provided in a known manner between the lead-out pipe 5 and the column 6.

A closure plate 8 is secured at the upper end 7 of the insulating column 2 tight as regards insulating medium, i.e., oil- or gas-tight. The closure plate 8 includes a downwardly projecting collar 9 which extends over the insulating column 2 from the outside. An inner support rim 10 rests on the end face 11 of the insulating column 2 under interposition of a seal 12.

The lead-out pipe 5 extends into a secondary system 16 preferably consisting of several annular cores 13 with associated secondary windings and of a cast resin cover 15 forming a ring 14. The secondary system 16 is secured exclusively on the closure plate 8 by way of insulating supports 17. These supports 17 are advantageously arranged at an inclination extending downwardly outwardly and are attached appropriate concentrically to the lead-out pipe 5. Additionally, the primary conductor generally designated by reference numeral 18 is exclusively secured on the closure plate 8. The primary conductor 18 is constructed U-shaped whereby the base 19 thereof extends at least approximately concentrically through the ring 14, respectively, the core or cores 13, whereby one leg 20 is secured in a connecting section 22 by means of this connecting section extended through the bore 100 of the closure plate 8 in an insulating medium-tight manner. An outer flange 23 provided at the leg 20 thereby serves as abutment. This leg 20 is adapted to be contacted from the outside, i.e., from below the closure plate 8. The connecting section 22 is thereby secured in an insulating medium-tight manner and insulated by an insulating bush 47 and an insulating ring 48 which may be in one piece with the insulating bush 47. The other leg 21 is secured on the inside 101 of the closure plate 8 from the inside thereof by means of the outer flange 23, especially is screwed onto the same. No bores extending toward the outside are provided thereby so that no seals are required. The connection takes place by way of an externally attached connection 106 so that the entire head 4 is at the potential connected thereto. It therefore involves a non-switchable primary conductor 18.

The closure plate 8 is so constructed that it laterally projects on all sides all the active parts, i.e., the secondary system 16 and the primary conductor 18. For example, it possesses a tub or plate-shape. A hood generally designated by reference numeral 24 which is constructed as top housing is placed over these aforementioned parts from above. A flange 27 is provided at the edge 26 delimiting the hood opening 25, by means of which the hood 24 is screwed-on to the closure plate 8 in a fluid-tight manner by way of threaded connections 28. The hood 24 may consist of a tubular section 29 and of a hood or pot-shaped cover 30 which are closed off at the abutment place 31 in an insulating medium-tight manner, in case of a metal construction, are brazed or welded together or screwed together, for example, are flangedly connected together and, for example, in case of a GFK construction (glass fiberreinforced synthetic resinous material) overlap at the abutment places 31. The hood 24, however, may also consist of a single drawn or pressed-out part or of a molded part.

At the ring 14 of the secondary system 16, the secondary lead-out lines are extended out along the circumference 32 at the bottom on a reinforced lead-out line place 33 into which the lead-out pipe 5 is inserted. The ring 14 is preferably externally metallized, for example, with a sprayed-on galvanizing layer. This metal layer is connected—as customary—to ground potential.

At least three supports 17 are provided. The supports 17 for the ring 14 may be formed-on at the ring 14 itself, i.e., may be cast in one piece of cast resin. However, they may also be formed-in by means of appropriate extensions or may be detachably connected with the ring 14.

The arrangement of an individual support 17 at the ring 14 can take place in such a manner that one threaded part 43 constructed as threaded sleeve or threaded bolt is formed-in into the cast resin cover 15 and the supports are adapted to be screwed together with the same by means of a counter-threaded part 44 formed-in into the same.

In order to compensate during operation a differing length expansion of the insulating column 2 and of the lead-out pipe 5 which may occur in case of temperature changes and in order to simplify also the assembly of the secondary system 16 on the lead-out pipe 5, the connection between the lead-out place 33 and the lead-out pipe 5 is constructed mechanically as longitudinally displaceable plug-in connection. The upper end of the lead-out pipe 5 is thereby coaxially surrounded and springily retained in the manner of a sliding seat by one or several contact springs 45, for example, by annular contact springs arranged in the ring about the lead-out pipe 5, preferably as collars with multiple slots.

Abutments 102 are formed-on or secured especially are screwed on at the closure plate 8 on the inside 101 thereof. Each abutment 102 includes appropriately one abutment plate 103 per support 17 whose abutment surfaces 35 are arranged preferably perpendicularly to the longitudinal axis L of the coordinated supports 17. The abutment plates 103 are provided with a bore 104, through which a threaded shank 37 of a fastening bolt 38 can be extended from below and can be screwed together with a threaded part of the support 17 constructed as threaded bushing 39.

The abutment plates 103 may be the one leg of an angle rail whose other leg is secured on the closure plate 8, for example, by bolts from the inside thereof.

Advantageously, one support plate 103 each is provided on each side of a prism 105 whereby this prism 105 is formed-on at the closure plate 8 or is secured thereon.

It is avoided by this type of the support fastening inside of the space of the hood 24 that bores have to be provided in the closure plate 8 and have to be closed off in an insulating medium-tight manner.

A voltage transformer generally designated by reference numeral 200 is provided above the secondary system 16, respectively, above the cast resin cover 15 thereof. The voltage transformer 200 is arranged inside of the one-piece or especially two-partite hood 24 and is secured within the same at least at two fastening lugs 201 provided thereat or at a partial flange or at a ring flange. Preferably, the cover 30 is constructed as dome and is connected in an insulating medium-tight manner with a lower cylindrical section, for example, the tubular section 29, especially is screwed together with the same. In order to enable a simple assembly of the combined transformer in accordance with the present invention, a plug-in arrangement 202 is provided in the lower part at the voltage transformer 200, preferably is screwed on or especially formed-on at the cast resin cover 203 of the high and low voltage windings 200.1 and 200.2. Preferably this is a multiple plug-in arrangement for the secondary lead-out lines of the voltage transformer 200 so that a voltage transformer 200 with several connections is provided therewith.

Above the current transformer, i.e., above its secondary system 16, respectively, the cast resin cover 15, a plug-in counter part 203 is rigidly secured in the lower part of the hood 24, respectively, of the top 4, for example, is screwed-together with the same. Preferably, the plug-in counterpart 203 is attached at the top of the secondary system 16 of the current transformer, for example, is screwed together with same or formed-on thereat. Lead-out lines terminate in this plug-in counterpart 203 which are formed-on externally, especially along the cast resin cover 15 or more favorably are formed-on at the same by means of casting resin or are formed-in into the same and are continued in the lead-out pipe 5. The lead-out lines are conducted in the lead-out pipe 5 to the terminal board in the base 3 of the transformer. In order to compensate for temperature- and/or pressure-conditioned longitudinal changes of the hood or the like, the plug-in connection 202, 204 is so constructed that the individual arrangements 202, 204 are axially displaceable with respect to one another in the assembled condition but remain in contact with each other.

The arrangement may thereby be made in such a manner that the assembly of the plug-in parts 202, 204 takes place directly and automatically during the mounting of the hood 24 or indirectly by way of intermediate connecting elements.

The subdivision of the hood 24 is provided advantageously within an area 205 between the lead-out conductor, i.e., in this case the base 19 of the primary conductor 18 and the leg 206 of the magnet core 207 extending through the windings 200.1 and 200.2 of the voltage transformer 200. In particular, this leg 206 is arranged in the lower part and the winding-free leg 208 in the upper part. The magnet core 207, respectively, 207.1 and the beginning of the inwardly disposed high voltage winding 200.1 are at a high voltage potential.

Preferably, the dome 30 is matched to the dimensions of the voltage transformer 200 and, as customary, may be smaller in diameter at least about the same than the remaining section of the hood 24. This possibility results with the construction of the magnet core 207 as frame core according to FIG. 4.

Advantageously, the magnet core may be constructed as shell core 207.1. The shell core is arranged preferably in a horizontal plane. Inter alia, a low type of construction results therefrom, and the diameter of the dome 30 must thereby be at least no larger than that of the cylindrical section 29. The fastening of the magnet core 207, respectively, 207.1 takes place directly or by way of angle or U-shaped sections 211 indirectly at the transformer head 4.

In order that during the mounting of the hood 24, respectively, of the voltage transformer 200, the plug-in connection can be mounted in the rotary direction in an accurate angular position without difficulty, coding elements 209 and counter pieces 210, for example, in the form of grooves and springs or pins 209.1 and bores 210.1 or the like are provided at the plug-in arrangements 202 and 204 and/or at the hood 24, respectively, at the dome 30 and at the closure plate 8, respectively, at the tubular section 29 and/or at the cast resin covers 15 and 203. An incorrect connection of the voltage converter can be avoided thereby.

Figure 5:
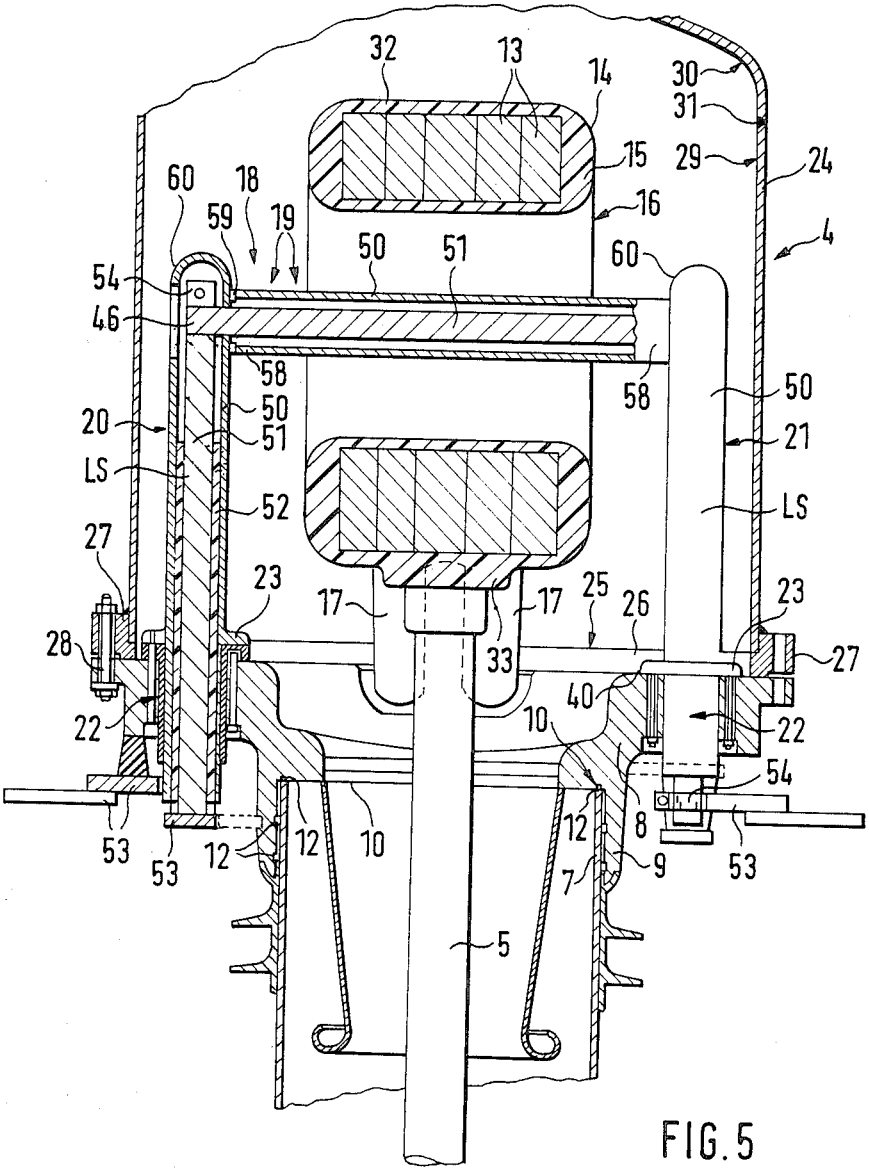
FIG. 5 is a cross-sectional view through the current transformer part of the combined transformer with a switchable primary winding in accordance with the present invention.

According to a further advantageous modified construction of the present invention illustrated in FIG. 5, the primary conductor 18 of the current transformer 16, 18 may consist of two or more parts, for example, of an angle member and of a leg or of a base and of two legs. In case of an angle member, the one angle leg forms the base 19 at which are attached the leg 20, respectively, 21. This type of construction permits a simple installation, especially with small core or ring inner diameters. With a three-partite construction, the legs 20, 21 are secured at an obtuse angle up to right angle at the ends of the rod-shaped base 19. The legs 20 and 21 may thereby be constructed as bolts. The insulation of the leg or of the legs 20 and/or 21 takes place with advantage by way of an insulating bush and by way of a ring which is preferably a flange of the insulating bush that is attached in a tight manner in the closure plate 8, for example, by being cast-in or by means of annular seals or the like. The ring or flange is screwed together in a sealing-tight manner, on the one hand, with the outer flange 23 of the legs 20 and 21, and, on the other hand, with the closure plate 8.

A further advantageous construction of the current transformer of the present invention resides in that the primary conductor 18 is constructed as coaxial double conductor in which are provided two U-shaped conductors insulated from one another. One of the conductors thereby consists preferably of an outer conductor 50 and the other of an inner conductor 51. These two conductors are separated from one another and fixed in position by appropriate insulating means which are at least in part formed by a solid dielectric 52 such as cast resin. The dielectric 52 is provided at least within the area of the connecting section 22 and thus at the same time provides a seal. The outer conductor 50 of the one leg 20 is thereby arranged insulated from the closure plate 8 by an insulating bush, and the outer conductor 50 of the other leg 21 is conductingly connected with the closure plate 8, for example, is secured therein directly without insulation.

Of course, the outer conductor 50 of the legs 20 and 21 thereby include an outer flange 23. The inner conductor 51 of the legs 20 and 21 are extended toward the outside in an insulated manner and connecting contacts 53 may be attached at the same correspondingly pivotally, for example, by means of a clamping strap 54. The same may be provided at the insulated outer conductor 50 of the leg 20.

Owing to this construction of the primary conductor 18 as double conductor, it is possible to utilize the two conductors separately or to connect the same in series or in parallel. A switching at the ratio 1:2 is thereby possible or, in case of a parallel connection, the primary conductor can be used for a higher current load. As individual conductor, however, each of the two coaxial conductors can carry also a separate measuring current.

The parallel connection takes place by interconnecting the inner conductors 50 and of the outer conductors of the leg 20 and of the leg 21.

The series connection takes place by connecting the connecting contact 53 at the left outer conductor by an electrical connection of the outer flange 23 with the electrically conductive closure plate 8, by a further electrical connection of the closure plate 8 and by way of a further connecting contact 53 with the left inner conductor 51 whereby a further contact with the right connecting contact 53 takes place at the right connecting section 22.

For connecting the base 19 of the primary conductor 18 with the legs 20, 21, clamping straps 54 may also be used. These clamping straps 54 may be made from the tubular or solid material of the legs 20, 21 or from the base 19, and more particularly, both with the outer conductors 50 as also with the inner conductors 51. This can take place by corresponding shaping and/or material-removing machining. The conductor part 55 which is to be clamped-in, may thereby be reduced in diameter.

For purposes of simple assembly, the outer conductor 50 of the legs 20, 21 includes a bore within the area 56 of the inner conductor 51 on the base 19.

The connection of the outer conductor 50 from the base 19 to the legs 20, 21 takes place by way of one flange 59 each attached at the ends 58 of the outer conductor 50 on the base 19, with which are threadably secured the ends 60 of the outer conductor 50 of the legs 20, 21 that project slightly inside of the top housing.

Advantageously, shields 212 are provided at all inner surfaces of the shell core 207. These shields may also form a common frame. They are advantageously constructed rounded-off downwardly outwardly or spherically at the end 213 pointing downwardly toward the ring 14 of the current transformer 16, 18.

Under certain circumstances, it may also be appropriate to arrange the shell core 207 in the direction of the lead-out conductor 19 of the current transformer primary conductor 18. The lead-out conductor 19 can extend horizontally through the entire head 4 whereby it protrudes on both sides out of the hood 24 and is insulated electrically from the same at least on one side thereof. However, it may also have the described U-shape. Possibly, it may also consist of two parallel strands so that it can be switched. One of the two strands is then attached at each leg electrically insulated from the closure plate.

The use of the current transformer with switchable primary winding of the combined transformer in accordance with the present invention is in particular of advantage if the voltage transformer part is decoupled by way of the plug-in connection 202, 204 and this transformer is then operated as pure current transformer.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A combined high voltage current and voltage transformer of head-type construction, comprising top housing means, a column of insulating material carrying the top housing means, a current transformer means, a voltage transformer means, the active parts of the current transformer means and above the same the active parts of the voltage transformer means being arranged in the top housing means, the current transformer means including a secondary system and primary conductor means constructed U-shaped whose base extends at least approximately concentrically through the ring of the secondary system of the current transformer means and whose two leg portions project downwardly, the top housing means including a closure plate means and a hood means, the two legs of the U-shaped primary conductor means of the current transformer means being secured exclusively on said closure plate means from the inside thereof, at least one of the legs being electrically insulated from the metallic closure plate means and being adapted to be contacted through the closure plate means from the outside and from below, and the ring of the secondary system of the current transformer means being also secured exclusively on the closure plate means by way of support means.

2. A combined transformer according to claim 1, wherein the primary conductor means of the current transformer means consists of at least two mutually insulated parallel strands, and wherein only one of said strands is in contact on one side with the closure plate means.

3. A combined transformer according to claim 1, wherein the ring of the secondary system of the current transformer means is secured inside in the top housing means on fastening elements.

4. A combined transformer according to claim 1, wherein the hood means includes on the inside thereof fastening lugs, an inner flange or parts of an inner flange, at which the voltage transformer means is secured, the voltage transformer means including in the lower part thereof within the area of the current transformer means a plug-in means, with which its secondary lead-out lines are connected, a plug-in counter part in the area of the upper part of the current transformer means, and wherein the plug-in connection of the parts of the plug-in means takes place automatically during the emplacement of the hood means.

5. A combined transformer according to claim 4, wherein said plug-in means is a multiple plug-in connection means.

6. A combined transformer according to claim 4, wherein the plug-in counter part is secured in the upper part of the current transformer means.

7. A combined transformer according to claim 4, wherein the secondary system of the current transformer means includes a cast resinous cover means, and wherein the plug-in counter part is secured at said cast resin cover means.

8. A combined transformer according to claim 7, wherein said plug-in counter part forms a structural unit with said cover means.

9. A combined transformer according to claim 4, wherein the plug-in connection means has an axial play in order to enable compensation of temperature-conditioned and/or pressure-conditioned axial longitudinal changes.

10. A combined transformer according to claim 7, wherein the lead-out lines are extended from the plug-in counter part along the cast resin cover means downwardly toward a lead-out pipe means.

11. A combined transformer according to claim 10, wherein the lead-out lines are formed-in into the cast resin cover means.

12. A combined transformer according to claim 7, wherein the plug-in means is attached to the lower part of the cast resin cover means.

13. A combined transformer according to claim 7, wherein the plug-in means is formed-on in the lower part of the cast resin cover means.

14. A combined transformer according to claim 1, wherein the hood means is two-partite and includes a cylindrical section adapted to be secured on the closure plate means in an insulating medium-tight manner and a dome adapted to be mounted on the cylindrical section and adapted to be secured thereat.

15. A combined transformer according to claim 1, wherein the hood means is subdivided within the area between the lead-out conductor of the current transformer means and a magnet core leg extending through the windings of the voltage transformer means.

16. A combined transformer according to claim 1, wherein the hood means is subdivided within the area between the lead-out of the primary conductor means of the current transformer means and a leg of a shell core means extending through the windings of the voltage transformer means, and wherein the two parts of the hood means are connected with each other in an insulating medium-tight manner at the abutment places.

17. A combined transformer according to claim 14, wherein the current transformer means is accommodated within the cylindrical section of the hood means and the voltage transformer means in the dome of the hood means.

18. A combined transformer according to claim 1, wherein the hood means together with the closure plate means and/or the plug-in means and/or the cast resin cover means includes coding elements protecting against unintentional angular displacements in the plug-in direction.

19. A combined transformer according to claim 14, wherein the dome is smaller in diameter at least within its upper part than the cylindrical section of the hood means.

20. A combined transformer according to claim 1, wherein the base of the primary conductor of the current transformer means extends substantially horizontally through substantially vertically arranged annular core means.

21. A combined transformer according to claim 1, wherein the voltage transformer means includes a core means constructed as shell core.

22. A combined transformer according to claim 21, wherein the shell core is arranged extending in a substantially horizontal plane.

23. A combined transformer according to claim 21, wherein the longitudinal direction of the shell core is arranged in the direction of the lead-out conductor of the primary conductor means of the current transformer means.

24. A combined transformer according to claim 21, wherein the core means of the voltage transformer means is electrically conductively connected with the hood means.

25. A combined transformer according to claim 21, further comprising shielding means provided at substantially all inner surfaces of the core means.

26. A combined transformer according to claim 25, wherein the shielding means are constructed substantially spherically in a downward outward direction at the end pointing toward the current transformer means.

27. A combined transformer according to claim 21, wherein the hood means and the magnet core means of the voltage transformer means are at high voltage potential and wherein the inner beginning of the inwardly arranged high voltage winding is connected to the high voltage potential.

* * * * *